United States Patent [19]

Akashi

[11] 4,270,248

[45] Jun. 2, 1981

[54] SLIDE FASTENER WITH BOTTOM STOP

[75] Inventor: Shunji Akashi, Kurobe, Japan

[73] Assignee: Yoshida Kogyo K.K., Tokyo, Japan

[21] Appl. No.: 61,883

[22] Filed: Jul. 30, 1979

[30] Foreign Application Priority Data

Jul. 31, 1978 [JP] Japan ..... 53-105407[U]

[51] Int. Cl.[3] ..... A44B 19/36

[52] U.S. Cl. ..... 24/205.11 R; 24/205.11 F

[58] Field of Search ..... 24/205.11 R, 205.11 F

[56] References Cited

U.S. PATENT DOCUMENTS

| | | | |
|---|---|---|---|
| 2,522,327 | 9/1950 | Winterhalter | 24/205.11 R |
| 3,280,437 | 10/1966 | Schwendt | 24/205.11 F |
| 3,964,136 | 6/1976 | Panzeri | 24/205.11 R |
| 4,104,767 | 8/1978 | Warren | 24/205.11 R |
| 4,152,813 | 5/1979 | Heimberger | 24/205.11 R X |

FOREIGN PATENT DOCUMENTS

| | | | |
|---|---|---|---|
| 1249193 | 11/1960 | France | 24/205.11 R |

*Primary Examiner*—Roy D. Frazier
*Assistant Examiner*—Peter A. Aschenbrenner
*Attorney, Agent, or Firm*—Hill, Van Santen, Steadman, Chiara & Simpson

[57] ABSTRACT

An improved slide fastener assembly incorporating an arrangement in which the stringer tapes of the fastener may be sewn into a garment prior to assembly with the slider and wherein the slider may then be assembled to the stringers without force. Upon such assembly the parts remain assembled by virtue of cooperating fastener elements having projecting portions that interengage with each other and the slider to prevent retrograde movement back out of the slider following assembly.

8 Claims, 12 Drawing Figures

SLIDE FASTENER WITH BOTTOM STOP

BACKGROUND OF THE INVENTION

The present invention relates to a slide fastener with a bottom stop of the type in which discrete interlocking fastener elements are cast onto the stringer tapes, via the beads attached thereto, by a pressure casting or die casting process. The bottom stop, as is well known, serves to inseparably secure the two halves of the slide fastener as well as to simultaneously limit the movements of the slider.

It has been long taken for granted in this art that a semi-finished-product slide fastener without a slider is much preferred to a finished-product slide fastener with a slider already incorporated therein, when being sewn to an article such as a garment fabric; since, in the case of a finished-product slide fastener, the already incorporated slider is liable to block the sewing needle or needles, of lowering of manufacturing efficiency. However, until now this has been a manufacturer's vain wish since in the bottom stop of metal or plastic has usually not been attached to the stringers until the latter has a slider mounted thereon.

One attempt to treat the problem is taught in U.S. Pat. No. 3,104,438 of Sept. 24, 1963 disclosed a slide fastener carrying a bottom stop which consists of three parts, one being attached to one stringer and the other two the other stringer, which are adapted to be assembled by being passed through the slider and permanently joined thereafter, to thereby a bottom stop.

However, it is to be noted that this prior art bottom stop, for at least one part thereof, must have a structural formation of such greater lateral dimension across the longitudinal axis of the slide fastener as to present, when the bottom stop parts are interengaged by the slider, a positive stop adapted for direct abutting opposition to movement of the slider in the direction of fastener element opening. This means that at least one part is wider than the the neck portion of the slider and the corresponding flange and consequently must be forcibly and compressedly thrust therebetween when inserted together with the other parts into the slider for assemblage therewith for presentation of the permanent bottom stop. This forcible thrust is liable to cause damage on and the bottom end part itself, the flange and/or the neck portion of the slider through which it is thrust, which naturally impairs the function as a bottom stop. In addition to this, the parts 6 and 7 of the prior art bottom stop are not designed to be stably held against displacement from each other perpendicularly to the plane of the slide fastener at their lower portion although they are so designed at their upper portion, so that the parts are liable to get out of proper coupling engagement with each other.

With the foregoing disadvantages of the prior art in view, it is a primary object of this invention to provide a slide fastener having a bottom stop comprising three parts which have a specific construction which enables them to smoothly enter the slider, without being forcibly compressed, for assemblage therebetween, and which, once they enter the slider, are assembled to provide a bottom stop, and provide a reliable function as such for a prolonged period of time.

It is a second object of this invention to provide a slide fastener having a bottom stop comprising three parts which has the specific construction to prevent them from getting displaced from each other particularly perpendicularly to the plane of the slide fastener even when subjected to severe stresses tending to move these respective parts normal to the same plane.

It is a third object of this invention to provide a slide fastener having a bottom stop comprising three parts which are brought onto the stringer tapes simultaneously when and in the same working operation as are the fastener elements, hence dispensing with any subsequent additional attaching operation, increasing the manufacturing efficiency.

It is a fourth object of this invention to provide a slide fastener having a bottom stop of the specific construction permitting passage of a slider therethrough subsequent to the mounting of the bottom stop upon stringers, consequently permitting sewing operation of the stringers without a slider or what we call "a semi-finished-product slide fastener without a slider" onto an article, thus leading to great enhancement of manufacturing efficiency.

The above objects are attained according to the present invention in a slide fastener comprising: (a) a pair of flexible stringer tapes carrying resilient marginal beads on and along the respective inner longitudinal edges thereof; (b) two rows of discrete interlocking fastener elements mounted on and along said marginal beads; (c) a slider slidably mounted on said rows of interlocking fastener elements and adapted to reciprocally slide along said interlocking fastener element rows to engage or disengage them for opening or closing of said slide fastener, said slider having a flared front end and a tapered rear end and including a neck portion formed centrally on said flared front end and a pair of opposed side flanges formed on its sides to define therebetween a Y-shaped channel for reciprocal slidable passage of said interlocking fastener element rows therethrough; and (d) a bottom end stop attached to said marginal beads at one end of said rows of interlocking fastener elements, said bottom stop including a first member mounted on one bead and adapted to engage at its upper part with the lower most interlocking fastener elements carried on the other bead, a second member mounted on said one bead a given distance below said first member and a third member mounted on said other bead a given distance below said lowermost element and disposed in opposed relation to the lower part of said first member and said second member, said third member being adapted to engage at its upper part with said first member so as to slide transversely of and along the plane of said slide fastener and to engage at its lower part with said second member so as to pivot along the plane of said slide fastener, said third member being in the shape of a polygon comprising an interior side lying inwardly of said other bead, side lying outwardly of said other bead, an upper interior corner contiguous to said interior side and an upper exterior corner contiguous to said exterior side, said third member being provided adjacent the upper interior corner with an abutment for abutting engagment with said neck portion of said slider, said upper interior corner being above said upper exterior corner thus to leave said resilient bead intact beside the former, the dimension of said third member to be measured perpendicularly to the side of said neck portion, as disposed when passing between said side of said neck portion and said corresponding flange, is slightly smaller than the distance between said side of said neck portion and said corresponding flange.

The above and other objects, features and advantages of this invention and the manner of attaining them will become more readily apparent, and the invention itself will best be understood, from the following description of preferred embodiments taken in connection with the acompanying drawings.

DESCRIPTION OF A PREFERRED EMBODIMENT

Figure 1:
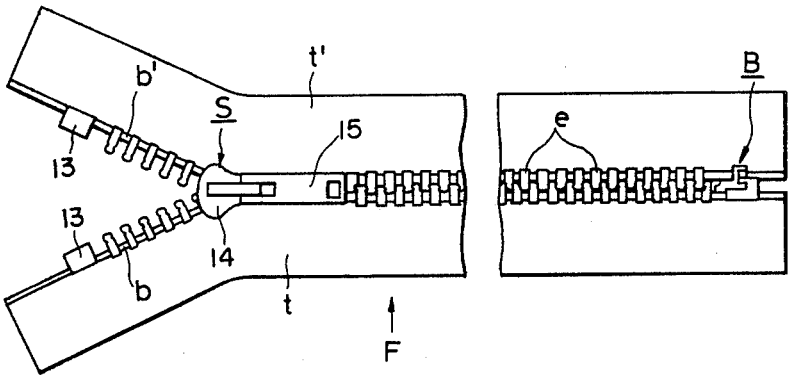
FIG. 1 is a front elevation of a whole slide fastener incorporating a bottom stop according to the first preferred embodiment of this invention with the slide fastener shown partly closed by a slider.
Figure 2:
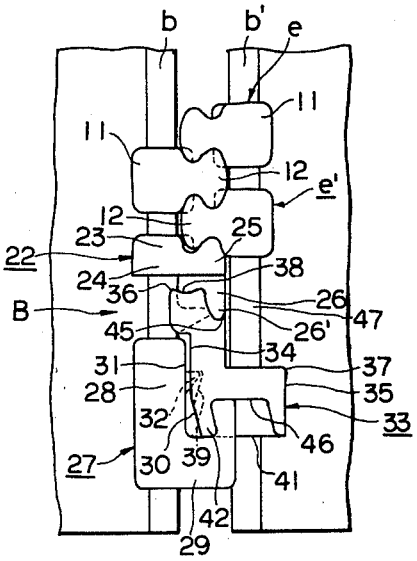
FIG. 2 is an enlarged fragmentary front elevation of the sliderfastener of FIG. 1 showing that three members of the bottom stop are fully engaged to provide a positive stop at the bottom of fastener element rows, the slider being already moved upwardly away from the bottom stop members.

Referring now to the drawings, generally illustrated in FIG. 1 is a slide fastener broadly designated F which comprises a pair of stringer tapes t, t′ carrying marginal beads b, b′ on and along their respective inner longitudinal edges, two rows of interlocking discrete fastener elements e affixed to the marginal beads b, b′ as by a pressure casting or die casting process, and a slider S, when moved in one direction, causing the fastener elements e on one tape t to interlock alternately with the fastener elements e on the other tape t′, and, when moved in the opposite direction, causing the fastener elements e to disengage. Each of the interlocking fastener elements e as shown in FIG. 2 includes an anchoring body 11 mounted on one of the bead b and a coupling head portion 12 extending inwardly therefrom for interlocking engagement with the corresponding head portions 12 of the two adjacent elements e on the opposite bead b′, the above interlocking engagement being possibly effected through any suitable projection-recess arrangement as has been previously known to and commonly used by those skilled in the art. Immediately above the rows of interlocking fastener elements e, as shown in FIG. 1, are provided two top stop members 13, 13′ to accomplish prevention of the slider S from upwardly leaving the two interlocking fastener element rows e. Immediately below the fastener element rows e is affixed a three part bottom stop broadly designated B and adapted to hold the two stringers (by "stringer" is conveniently meant a slide fastener half as is acknowledged in this art and the term is so used herein.) Together at its bottom and to prevent the sliders S from downwardly leaving the fastener element rows e, which bottom stop does constitute the present invention and will be later explained in detail.

The slider S, as is apparent in FIG. 1, broadly comprises a slider body 14 and a pull tab 15 pivotally connected in position thereto and available for the manipulation of the slider thereby along the interlocking fastener element rows e. The slider body 14, as is better shown in horizontal section in FIGS. 4(*a*), 4(*b*) and 4(*c*), has a flared front end 16 and a tapered rear end 17, thus providing a forwardly flared configuration, and includes a neck portion 18 provided at and centrally of the flared front end 16 and two flanges 19, 19′ provided on and along the opposed side edges of the slider body 14 and disposed divergent upwardly so as to define with the neck portion a Y-shaped horizontal channel 20 through which the two rows of fastener elements e are adapted to be slidably guided for either engagement or disengagement thereof for opening or closing of the slide fastener F. The neck portion 18 is substantially in the shape of an inverted isosceles triangle, when viewed in cross-section as in FIGS. 4, with its equal-length sides 21, 21′ converging rearwardly or towards the tapered rear end 17, and disposed substantially in spaced parallel relation to the corresponding portions of the respective flanges 19, 19′.

Figure 3:
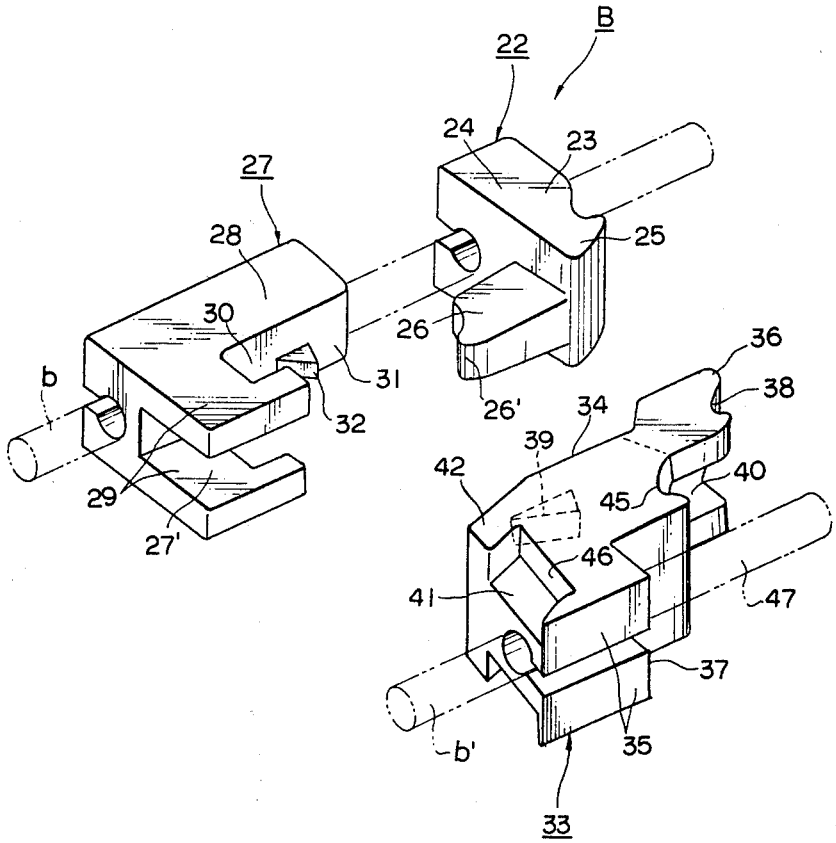
FIG. 3 is an enlarged perspective view of the three bottom stop members of FIG. 2 which are shown in uncoupled disposition.

According to the first embodiment of this invention, the bottom stop B, as is better shown in FIGS. 2 and 3, comprises three bottom stop members 22, 27, 33 mounted on both the beads b, b′ as by press-casting or die-casting process simultaneously when and in the same working operation as the interlocking fastener elements e are mounted. The latter and the bottom stop members may be made of any appropriate metal, for example, of zinc alloy or of a synthetic material, such as polyamid, or the like.

For convenience's sake, the left hand bead, when viewed in FIG. 2, is termed a first bead b and the right hand bead a second bead b′.

A first member 22 of the bottom stop B is mounted on the first bead b immediately below the lowermost element e′ mounted on the second bead b′ for coupling engagement therewith. The first member 22 comprises a main body 23 substantially identical in construction with the upper half of the interlocking fastener element e and including an anchoring portion 24 attached to said first bead b and a coupling portion 25 integrally formed therewith so as to project inwardly therefrom for interlocking engagement with the lowermost element e′, and a prong 26 formed at the lower end of the coupling portion so as to extend downwardly therefrom in spaced parallel relation with the first bead b for engagement with a third member hereinafter described. The prong 26 is thinned in the dimension measured perpendicularly to the plane of the slide fastener and is formed with a convex tip 26′.

A second member 27 is also mounted on the first bead b a given distance below the first member 22 and comprises an anchoring portion 28 mounted on the first bead b and being substantially in the shape of an elongated square prism and a coupling portion 29 integrally formed at the lower end thereof so as to extend inwardly therefrom perpendicularly thereto. The coupling portion 29 is cranked to define with the anchoring portion 28 an upwardly-open groove 30. Integrally and protrusively formed centrally on the interior side surface 31 of the anchoring body 28 is a protuberant lug 32 which is in any suitable cross-sectional shape, such as a triangle or a sector, which suits for fitting engagement with a recess in the third member later described. The cranked coupling portion 29 is bifurcated, as is shown in FIG. 3, to provide between a slot 27' running along the plane of the slide fastener F.

A third member 33 is mounted on the second bead b' a given distance below the lowermost fastener elements e' and disposed in opposed relation to the lower part of the first member 22 and the most part of the second member 27. The third member 33 is very generally in the shape of a trapezoid with the interior side 34 positioned inwardly of the second bead b' being longer than the exterior side 35 outwardly thereof, and the upper interior corner 36 contiguous to the interior side 34 is above the upper exterior corner 37 contiguous to the exterior side 35, thus leaving the second bead b' intact immediately beside the upper interior corner 36 to provide an intact bead portion 47. The third member 33 is notched adjacent the upper interior corner 36 in the outline complementary with the bottom of the neck portion 18, thus to provide an abutment 35 for abutting engagement with the neck portion 14 after the assemblage of the bottom stop members 22, 27, 33 within the slider S. Formed in the middle of the interior side 34 is a recess 39 which is of a contour such that the protuberant lug 32 of the second member 27 is brought into fitting engagement in the recess 39.

The third member 33 is bifurcated also at the upper interior corner 36 to provide between a channel 40 running along the plane of the slide fastener F and adapted to receive the thinned prong 26 for lateral slidable reciprocation of the latter through the former along the plane of the slide fastener F. Formed in the third member 33, contiguous to and outwardly of the abutment 38 is a concave 45 which is open upwardly for fitting engagement with the convex tip 26' of the first member 22 when the slider S is moved so upwardly apart from the bottom end stop members as not to affect the latter.

The third member 33 is stepped at 46 on both the surfaces and partly along the lower end thereof to provide a thinned flange 41 and a projecting rim 42 contiguous thereto and extending downwardly along the interior side 34 of said third member 33. The projecting rim 42 of the third member 33 is adapted to come into loose engagement with the upwardly open groove 30 of the second member 27, while the thinned flange 41 of the former is adapted to be loosely received through and within the furrow 27' of the latter for pivotal movement of the former relative to the latter.

According to the first embodiment, importantly, the dimension of the third member 33 to be measured perpendicularly to the second bead b' is slightly smaller than the distance between the relevant side 21' of the neck portion 18 and the confronting part of the corresponding flange 19.

Figure 4A:
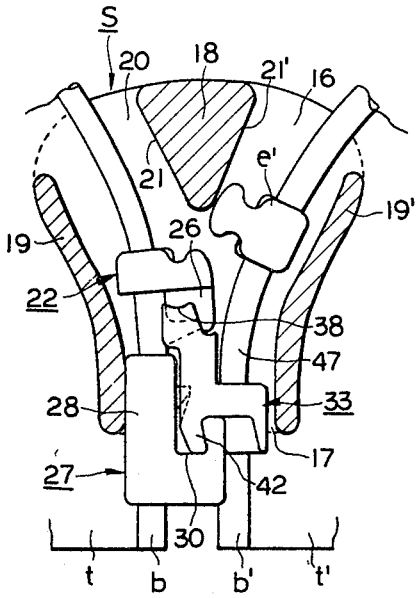
FIGS. 4(*a*), 4(*b*) and 4(*c*) are front elevations of the bottom stop members of FIG. 2 with a slider shown in horizontal section, showing sequential movement of the respective members in which one of the members is being brought into abutting engagement with the neck portion of the slider.
Figure 4B:
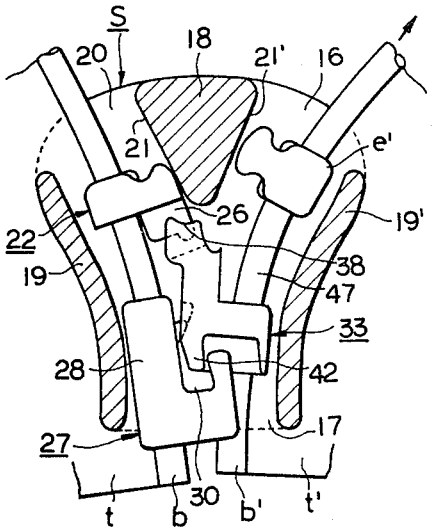
Figure 4C:
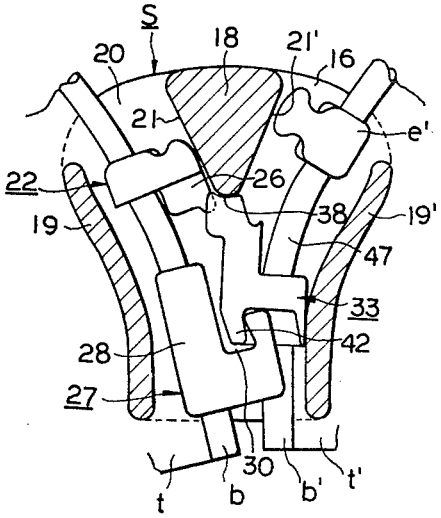

With the structural features described in the foregoing, the bottom stop B according to the first embodiment functions like this. It is to be noted in connection with the fourth object of this invention mentioned earlier that the two separate stringers incorporating the three bottom stop members 22, 27, 33 may have been already sewn to an article such as a garment fabric (not shown), which fact will reflect the enhancement of the manufacturing efficiency. For joining the separate stringers to a finished slide fastener, the bottom stop members 22, 27, 33 mounted immediately below the fastener element rows are first introduced through the Y-shaped channel 20 into the slider S from its flared front end 16, upon which the dimensional feature of the third member 33 makes sense to ensure smooth insertion of the third member 33 between the relevant side 21' of the neck portion 18 and the confronting portion of the corresponding flange 19, hence dispensing with forcible thrust of the former through the latter. The three members 22, 27, 33, once inserted to assume the disposition indicated in FIG. 4(*a*), get engaged with each other as mentioned earlier, thereby to assemble the two separate stringers into a complete slide fastener F. Pulling the stringers upwardly as indicated by a one-headed arrow in FIG. 4(*b*) makes the intact bead portion 47 beside the abutment 38 of the third member 33 to move upwardly just along the upwardly flared flange 19, rendering it progressively remote from the longitudinal axis of the slider S. On the other hand, the third member 33 itself is held in the original lateral position since not affected by the separating intact bead portion 47. Further pull of the stringers brings the abutment 38 into abutting engagement with the bottom of the neck portion 18, thus positively blocking the slider S for reliable prevention thereof from coming off the fastener element rows e, as indicated in FIG. 4(*c*).

It is to be noted here that notwithstanding such dimensional feature permitting smooth insertion, the third member 33 can retain reliable function as a bottom stop in cooperation with the rest of two members 22, 27. Paraphrasing this from the aspect of the advantage of this invention over the prior art earlier mentioned, there are caused damages neither on the third member 33 itself nor on the side of the neck portion 18 and the confronting flange 19 when the former is inserted between the latter two into the slider S for engagement with the other two members 22, 27, as would be encountered by the prior art bottom stop. FIG. 2 shows the relative disposition of the three members 22, 27, 33, after they are already assembled by the slider S to the singly operative bottom stop and then the slider S is moved so upwardly along the fastener element rows e as not to effect the bottom stop. Shown herein are the following engagements: (I) the thinned prong 26 of the first member 22 is received within the channel 40 of the third member 33; (II) the thinned flange 41 of the third member 33 is received within the furrow 27' of the second member 27; (III) the convex tip 26' of the first member 22 is received within the concave 45 of the third member 33; (IV) the projecting rim 42 of the third member 33 is received within the groove 30 of the second member; and (V) the protuberant lug 32 of the second member 27 is received within the recess 39 of the third member 33. The engagements (I) and (II) prevent the relative displacement of the members 22, 27, 33 perpendicularly to the plane of the slide fastener, (III) and (IV) the relative displacement of the members transversely of the slide fastener, (V) both the displacements. These are combined to mean that all the three members, once assembled, are well prevented by their mutual cooperation from getting displaced with each other both perpendicularly to the slide fastener plane and transversely of the slide fastener, thereby enjoying reliable function as a bottom stop for a prolonged period of time.

Figure 5:
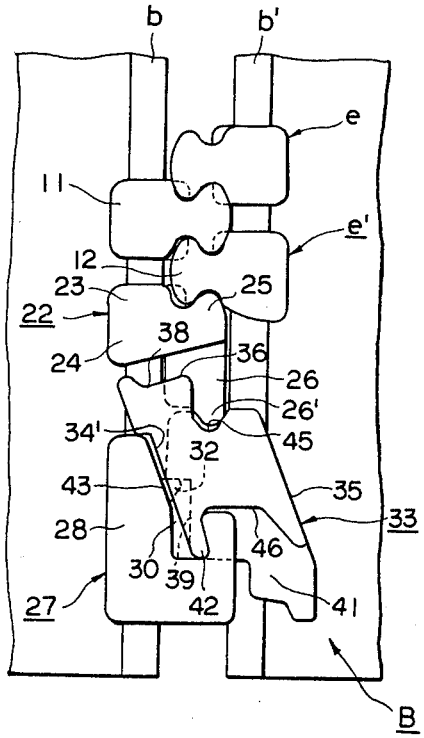
FIG. 5 is a view similar to FIG. 2 but shows a bottom stop according to a second preferred embodiment of this invention.
Figure 6:
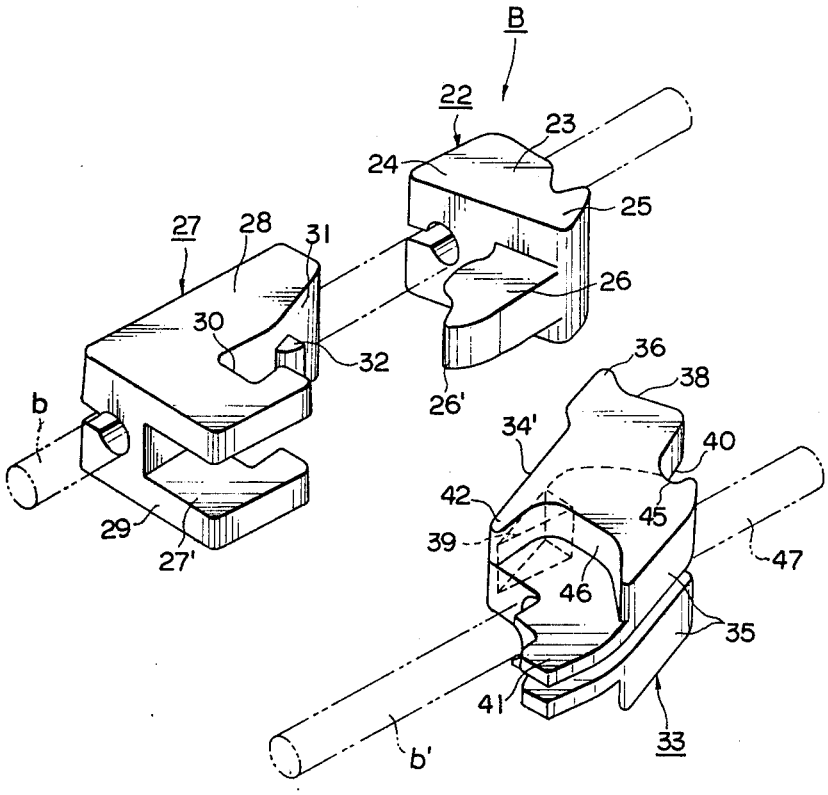
FIG. 6 is a view similar to FIG. 3 but shows the bottom stop of FIG. 5.
Figure 7A:
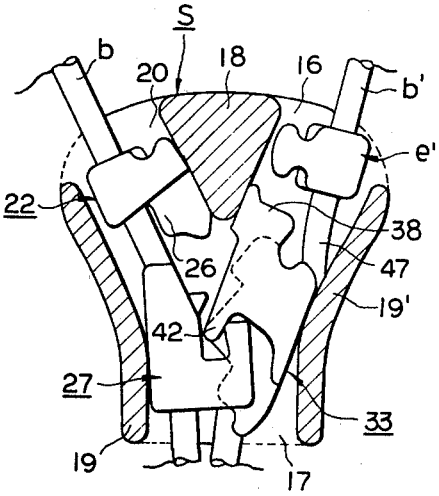
FIGS. 7(*a*), 7(*b*) and 7(*c*) are front elevations of the bottom stop members of FIG. 5 with a slider shown in horizontal section, showing sequential movement of the respective members in which the bottom stop members are first introduced into the slider and then one of the bottom stop members is brought into abutting engagement with the neck portion of the slider.
Figure 7B:
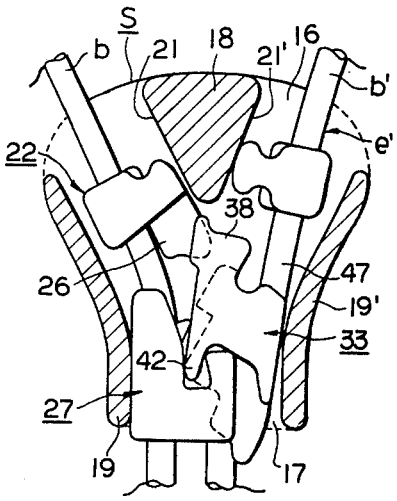
Figure 7C:
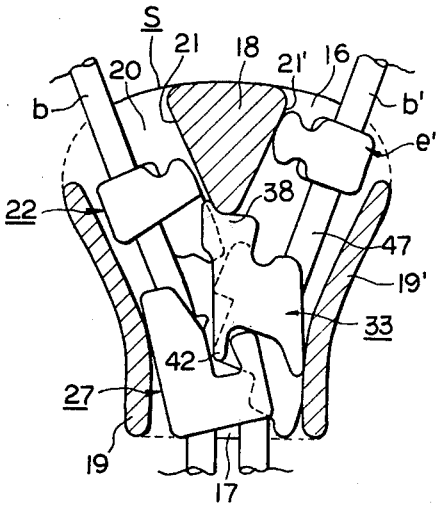

FIGS. 5 through 7, inclusive, show the second embodiment of this invention which is identical in construction to the preceding embodiment except for the slanted disposition of the third member 33 relative to the second bead b′ and the corresponding provision of a bevelled surface 43 on the interior side surface 31 of the second member 27. The slanted disposition of the third member results in provision of an interior oblique side surface 34′ which is adapted for surface engagement with the bevelled surface 43 of the second member 27. Due to the slanted disposition of the third member 33 relative to the second bead b′ , the third member 33 must be forcibly oriented so as to compensate for the slant, by resorting the resiliency of the second bead b′, when passing through between the side 21′ for the neck portion 18 and the corresponding flange 19′ as indicated in FIG. 7(*a*). Upon passing beyond and disengaging from the bottom of the neck portion 18, the third member 33 is automatically restored to the slanted disposition indicated in FIG. 7(*b*) by resiliency of the second bead b′, in which the abutment 38 of the third member 33 is brought into registry with the neck portion 18 of the slider S. An upward pull of the stringers through the slider S brings the abutment 38 of the third member 33 into abutting engagement with the bottom of the neck portion 18 of the slider S, as indicated in FIG. 7(*c*), blocking the third member 33, thus preventing the slider S from coming off the fastener element rows e. The automatic restoration of the third member 33 by means of resiliency of the second bead b′ is conducive to promotion of the certainty of bringing the abutment 38 into registry with the neck portion 18, thereby further ensuring the reliable function of the bottom stop as such.

Figure 8:
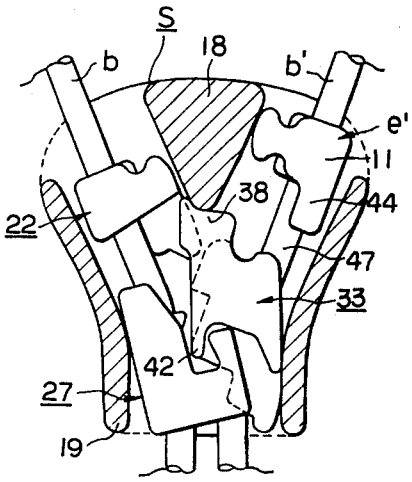
FIG. 8 is a front elevation of a bottom stop according to the third preferred embodiment of this invention with a slider shown in horizontal section.

FIG. 8 shows the third embodiment of this invention in which the lowermost element e′ is provided at the lower end of the anchoring body 11 thereof with an extension 44 which is formed integrally therewith and extends downwardly therefrom in close alignment with the second bead b′ and terminating halfway between the lowermost element e′ and the third member 33. The provision of the extension 44 along the second bead b′ adds to the stiffness thereof between the lowermost fastener element e′ and the third member 33, which helps to bring about prevention of the second bead b′ against the lateral displacement which would objectionably cause the third member 33 out of engagement with the remaining two 22, 27, thereby marring the function of the bottom stop as such. In addition to this, it adds to the resiliency of the second bead b′, which advantageously leads to holding the third member 33 in slanted disposition, hence ensuring the stopping function of the bottom stop.

Although the invention has been described with a certain degree of particularity, it is understood that the present disclosure has been made only by way of example and that numerous changes in the details of construction and the combination and arrangement of parts may be restored to without departing from the spirit and the scope of the invention as hereinafter claimed.

What is claimed is:

1. A slide fastener comprising:

(a) a pair of flexible stringer tapes carrying resilient marginal beads on and along the respective inner longitudinal edges thereof;

(b) two rows of discrete interlocking fastener elements mounted on and along said marginal beads;

(c) a slider slidably mounted on said rows of interlocking fastener elements and adapted to reciprocally slide along said interlocking fastener element rows to engage or disengage them for opening or closing of said slide fastener, said slider having a flared front end and a tapered tear end and including a neck portion formed centrally on said flared front end and a pair of opposed side flanges formed on its both sides to define therebetween a Y-shaped channel for reciprocal slidable passage of said interlocking fastener element rows therethrough; and (d) a bottom end stop attached to said marginal beads at one end of said rows of interlocking fastener elements, said bottom stop including a first member mounted on one bead and adapted to engage at its upper part with the lowermost interlocking fastener element carried on the other bead, a second member mounted on said one bead a given distance below said first member and a third member mounted on said other bead a given distance below said lowermost element and disposed in opposed relation to the lower part of said first member and said second member, said third member being adapted to engage at its upper part with said first member so as to slide transversely of and along the plane of said slide fastener and to engage at its lower part with said second member so as to pivot along the plane of said slide fastener, said third member being in the shape of a polygon comprising an interior side lying inwardly of said other bead, an exterior side lying outwardly of said other bead, an upper interior corner contiguous to said interior side and an upper exterior corner contiguous to said exterior side, said third member being provided adjacent said upper interior corner with an abutment for abutting engagement with said neck portion of said slider, said upper interior corner being above said upper exterior corner thus to leave said resilient bead intact beside the former, the dimension of said third member as disposed when passing between said side of said neck portion and said corresponding flange, being slightly smaller than the distance between said side of said neck portion and said corresponding flange.

2. A slide fastener according to claim 1, in which said first member comprises an anchoring portion attached to said one bead, a coupling portion integrally formed therewith and projecting inwardly therefrom for interlocking engagement with said lowermost fastener element and a tongue integrally formed at the lower end of said coupling portion so as to extend downwardly therefrom in spaced parallel relation with said one bead and thinned in the dimension measured perpendicularly to the plane of said slide fastener, said third member being bifurcated at said upper interior corner to provide between a channel running along the plane of said slide fastener within which said tongue is received for lateral slidable reciprocation of the latter through the former along the plane of said slide fastener.

3. A slide fastener according to claim 2, in which said third member is provided adjacent and outwardly of said channel with a concave which is open upwardly, said tongue having a convex tip for fitting engagement with said upwardly open concave of said third member when said slider is moved so upwardly apart from said bottom end stop as not to affect the latter.

4. A slide fastener according to claim 1 in which said second member comprises an anchoring body attached to said one bead and a coupling portion formed at its lower end integrally therewith so as to extend inwardly therefrom perpendicularly thereto, said coupling portion, when viewed in plan, being cranked thus to define with said anchoring body an upwardly open groove, said third member being stepped on both the surfaces and partly along the lower end thereof to provide a thinned flange and a projecting rim contiguous thereto and extending downwardly along the interior side of said third member, said projecting rim being loosely received within said upwardly open groove of said second member for pivotal engagement of said third member relative to said second member.

5. A slide fastener according to claim 4, in which said second member comprises a protuberant lug integrally formed on the interior side surface of the anchoring body to project inwardly therefrom, said third member being cut away in the interior side surface thereof to provide a recess for receiving said protuberant lug.

6. A slide fastener according to claim 4, in which said coupling portion of said second member is bifurcated to provide a furrow running along the plane of said slide fastener, through which furrow said thinned flange of said third member is loosely received.

7. A slide fastener according to claim 1, in which said third member is slanted relative to said other bead thus to provide an interior oblique side surface, said anchoring body of said second member being bevelled at its upper interior side surface to provide a bevelled surface for surface engagement with said interior oblique side surface of said third member.

8. A slide fastener according to claim 1, in which said lowermost fastener element is provided at the lower end with an extension which extends downwardly substantially in close alignment with said other bead.

* * * * *